US010168649B2

(12) United States Patent
Adachi

(10) Patent No.: US 10,168,649 B2
(45) Date of Patent: Jan. 1, 2019

(54) FIXING DEVICE AND IMAGE FORMING APPARATUS INCORPORATING SAME

(71) Applicant: Tomoya Adachi, Kanagawa (JP)

(72) Inventor: Tomoya Adachi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/635,564

(22) Filed: Jun. 28, 2017

(65) Prior Publication Data

US 2018/0011434 A1 Jan. 11, 2018

(30) Foreign Application Priority Data

Jul. 5, 2016 (JP) ..... 2016-133504

(51) Int. Cl.
*G03G 15/20* (2006.01)

(52) U.S. Cl.
CPC . *G03G 15/2025* (2013.01); *G03G 2215/2035* (2013.01)

(58) Field of Classification Search
CPC ..... G03G 15/2025; G03G 15/2075
See application file for complete search history.

(56) References Cited

U.S. PATENT DOCUMENTS 5,951,824 A * 9/1999 Deshpande ..... D21F 3/0218 162/358.3
6,456,819 B1 * 9/2002 Abe ..... G03G 15/2064 219/216
2008/0187372 A1 * 8/2008 Kato ..... G03G 15/6591 399/328
2010/0086324 A1 * 4/2010 Smith ..... G03G 15/2053 399/67
2014/0153983 A1 * 6/2014 Fujii ..... G03G 15/2053 399/329
2014/0369726 A1 * 12/2014 Soeda ..... G03G 15/2053 399/329
2015/0093167 A1 * 4/2015 Hazeyama ..... G03G 15/2053 399/329

FOREIGN PATENT DOCUMENTS

JP 2006-078965 3/2006
JP 2014-164245 9/2014
JP 2015-225286 12/2015

* cited by examiner

*Primary Examiner* — Carla J Therrien
(74) *Attorney, Agent, or Firm* — Oblon, McClelland, Maier & Neustadt, L.L.P.

(57) ABSTRACT

A fixing device includes a nip formation pad, an endless fixing rotator, a pressure rotator, and a lubricant transfer portion. The endless fixing rotator has an inner circumferential surface adhered with a lubricant. The pressure rotator is pressed against the nip formation pad via the fixing rotator to form a nip through which an image is fixed on a recording medium. The lubricant transfer portion transfers the lubricant toward a center side in a width direction perpendicular to a rotational direction of the fixing rotator.

14 Claims, 6 Drawing Sheets

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2016-133504, filed on Jul. 5, 2016 in the Japan Patent Office, the entire disclosure of which is hereby incorporated by reference herein.

BACKGROUND

Technical Field

Aspects of this disclosure relate to a fixing device and an image forming apparatus incorporating the fixing device.

Related Art

A fixing device is known that includes an endless fixing rotator with a lubricant adhering to an inner circumferential surface of the fixing rotator, a nip formation pad, and a pressure rotator pressed against the nip formation pad with the fixing rotator interposed between the pressure rotator and the nip formation pad to form a fixing nip. The fixing device fixes an image on a recording medium passing through the fixing nip.

SUMMARY

In an aspect of the present disclosure, there is provided a fixing device that includes a nip formation pad, an endless fixing rotator, a pressure rotator, and a lubricant transfer portion. The endless fixing rotator has an inner circumferential surface adhered with a lubricant. The pressure rotator is pressed against the nip formation pad via the fixing rotator to form a nip through which an image is fixed on a recording medium. The lubricant transfer portion transfers the lubricant toward a center side in a width direction perpendicular to a rotational direction of the fixing rotator.

In another aspect of the present disclosure, there is provided an image forming apparatus that includes an image bearer, an image forming device, a transfer device, and a fixing device. The image forming device forms a toner image on the image bearer. The transfer device transfers the toner image from the image bearer onto a recording medium. The fixing device fixes the toner image on the recording medium. The fixing device includes a nip formation pad, an endless fixing rotator, a pressure rotator, and a lubricant transfer portion. The endless fixing rotator has an inner circumferential surface adhered with a lubricant. The pressure rotator is pressed against the nip formation pad via the fixing rotator to form a nip through which the image is fixed on the recording medium. The lubricant transfer portion transfers the lubricant toward a center side in a width direction perpendicular to a rotational direction of the fixing rotator.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
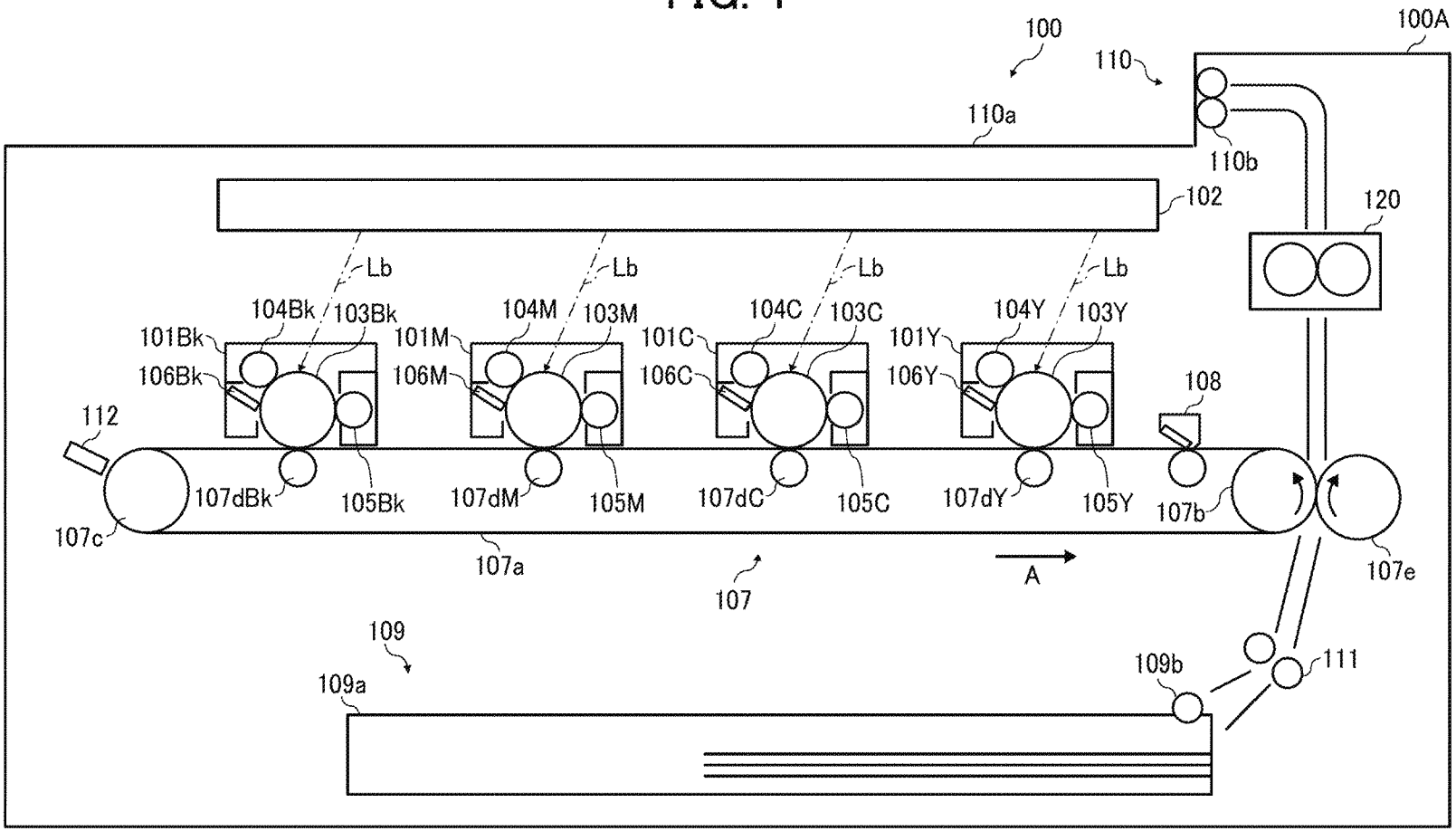
FIG. 1 is a cross-sectional view of an entire configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

As used herein, the singular forms "a", "an", and "the" are intended to include the plural forms as well, unless the context clearly indicates otherwise.

Although the embodiments are described with technical limitations with reference to the attached drawings, such description is not intended to limit the scope of the disclosure and all of the components or elements described in the embodiments of this disclosure are not necessarily indispensable.

Below, a description is given of an electrophotographic image forming apparatus 100 as an image forming apparatus according to an embodiment of the present disclosure.

FIG. 1 is a cross-sectional view of an entire configuration of the image forming apparatus 100. As illustrated in FIG. 1, the image forming apparatus 100 has a tandem configuration in which photoconductive drums 103Y, 103C, 103M, and 103Bk are arranged side by side. The photoconductive drums 103Y, 103C, 103M, and 103Bk serve as image bearers to bear toner images of separated colors of yellow (Y), cyan (C), magenta (M), and black (Bk), respectively. Note that the image forming apparatus according to an embodiment of the present disclosure is not limited to such a tandem image forming apparatus, but may have another configuration. The image forming apparatus according to an embodiment of the present disclosure is not also limited to a color image forming apparatus, but may be another type of image forming apparatus. For example, the image forming apparatus according to an embodiment may be a copier, a facsimile machine, or a multifunction peripheral having one or more capabilities of these devices.

Process cartridges 101Y, 101C, 101M, and 101Bk for yellow (Y), cyan (C), magenta (M), and black (Bk) are detachably attached to the image forming apparatus 100. An apparatus body 100A of the image forming apparatus 100 is constituted of a housing to accommodate various components. Also, the housing includes a conveyance passage, defined by internal components of the image forming apparatus 100, along which a sheet as a recording medium is conveyed from a sheet feeding device 109 to a sheet ejection unit 110. Toner bottles are removably mounted below a sheet ejection tray 110*a* in the apparatus body 100A. The removable toner bottles contain color toners of yellow, cyan, magenta, and black. The apparatus body 100A also includes a waste toner container having an inlet connected to a toner delivery tube. The waste toner container receives waste toner delivered through the toner delivery tube.

The optical writing device 102 includes a semiconductor laser as a light source, a coupling lens, an f-θ lens, a toroidal lens, a deflection mirror, and a polygon mirror. The optical writing device 102 emits laser beams Lb for yellow, cyan, magenta, and black onto the photoconductive drums 103Y, 103C, 103M, and 103Bk included in the process cartridges 101Y, 101C, 101M, and 101Bk to form electrostatic latent images on the photoconductive drums 103Y, 103C, 103M, and 103Bk. Image data carried in the laser beams Lb to be emitted are composed of single color image data of yellow, cyan, magenta, and black, into which a desired full color image is separated.

In the present embodiment, an imaging unit includes four process cartridges 101Y, 101C, 101M, and 101Bk. For example, the process cartridge 101Y to form an yellow toner image includes the photoconductive drum 103Y, a charging roller 104Y, a developing device 105Y, and a cleaning blade 106Y. In the process cartridge 101Y, charging, optical writing, developing, transfer, cleaning, and discharging processes are performed in this order.

First, the charging roller 104Y electrostatically charges an outer circumferential surface of the photoconductive drum 103Y. The optical writing device 102 conducts optical writing on the charged outer circumferential surface of the photoconductive drum 103Y to form an electrostatic latent image constituted of electrostatic patterns on the photoconductive drum 103Y. The developing device 105Y supplies and adheres yellow toner to the electrostatic latent image formed on the photoconductive drum 103Y, thereby developing the electrostatic latent image with the yellow toner into a visible yellow toner image. The yellow toner image is primarily transferred onto the transfer device 107. Thereafter, the cleaning blade 106Y removes residual toner from the photoconductive drum 103Y, rendering the photoconductive drum 103Y to be ready for a next primary transfer. Finally, the discharging process is performed to remove residual static electricity from the photoconductive drum 103Y.

The photoconductive drum 103Y includes a photoconductive layer made of an inorganic or organic photoconductor on a cylindrical surface and rotates at a linear velocity. The charging roller 104Y presses against the outer circumferential surface of the photoconductive drum 103Y and rotates with the rotation of the photoconductive drum 103Y. A high voltage power supply applies a direct current (DC) bias or a superimposed bias, in which an alternating current (AC) is superimposed on the direct current, to the charging roller 104Y, thus uniformly charging the outer circumferential surface of the photoconductive drum 103Y at a given surface electric potential. The developing device 105Y includes a supply section to supply yellow toner to the photoconductive drum 103Y and a developing section to adhere yellow toner to the photoconductive drum 103Y. The cleaning blade 106Y includes an elastic band made of, e.g., rubber, and a toner remover such as a brush. The removable developing device 105Y is housed in the apparatus body 100A.

Each of the process cartridges 101C, 101M, and 101Bk has a configuration similar to, even if not the same as, the configuration of the process cartridge 101Y. Toner images of cyan, magenta, and black are transferred from the process cartridges 101C, 101M, and 101Bk, respectively, to the transfer device 107.

The transfer device 107 includes a transfer belt 107*a*, a driving roller 107*b*, a tension roller 107*c*, primary transfer rollers 107*d*Y, 107*d*C, 107*d*M, and 107*d*Bk, and a secondary transfer roller 107*e*. The transfer belt 107*a* is an endless-shaped belt, which has no terminal end, stretched taut between and around the driving roller 107*b* and the tension roller 107*c*. As the driving roller 107*b* and the tension roller 107*c* rotate, the transfer belt 107*a* rotates, or moves in cycles, in a rotational direction indicated by arrow A in FIG. 1.

The transfer belt 107*a* contacts the process cartridges 101Y, 101C, 101M, and 101Bk at area of contacts to form primary transfer nips between the transfer belt 107*a* and the process cartridges 101Y, 101C, 101M, and 101Bk, respectively. The primary transfer rollers 107*d*Y, 107*d*C, 107*d*M, and 107*d*Bk area applied with transfer biases of +400 V to +2500 V from a single high voltage power supply to form transfer electric fields. The secondary transfer roller 107*e* presses an outer circumferential surface of the transfer belt 107*a*, thereby pressing against the driving roller 107*b* via the transfer belt 107*a*. Thus, an area of contact, herein called a secondary transfer nip, is formed between the secondary transfer roller 107*e* and the transfer belt 107*a*.

The belt cleaning device 108 is disposed between the secondary transfer nip and the process cartridge 101Y in the rotational direction A of the transfer belt 107*a*. The belt cleaning device 108 includes a toner remover and the toner conveyance tube. The toner remover removes residual toner, which remains on the outer circumferential surface of the transfer belt 107*a*, from the transfer belt 107*a*. The residual toner thus removed is conveyed as waste toner through the toner conveyance tube to the waste toner container.

The sheet feeding device 109 is disposed at a lower part of the apparatus body 100A and includes a sheet tray 109*a* and a sheet feeding roller 109*b*. The sheet tray 109*a* accommodates recording sheets of paper P (hereinafter, sheets P) as recording media. The sheet feeding roller 109*b* picks up an uppermost sheet P from the sheets P on sheet tray 109*a* sheet by sheet, and feeds the uppermost sheet P to the conveyance passage.

A sheet ejection unit 110 disposed above the optical writing device 102 and atop the apparatus body 100A. The sheet ejection unit 110 includes a sheet ejection tray 110*a* and a sheet ejection roller pair 110*b*. The sheet ejection roller pair 110*b* ejects a sheet P bearing an image onto the sheet ejection tray 110*a*. In sheet ejection unit 110, sheets P ejected from the conveyance passage by the sheet ejection roller pair 110*b* are stacked one on another.

A registration roller pair 111 adjusts conveyance of the sheet P along the conveyance passage, after the sheet P is fed by the sheet feeding roller 109*b* of the sheet feeding device 109.

For example, a registration sensor is interposed between the sheet feeding roller 109*b* and the registration roller pair 111 on the conveyance passage inside the apparatus body 100A to detect a leading end of the sheet P conveyed along the conveyance passage. When a predetermined time elapses after the registration sensor detects the leading end of the sheet P, the registration roller pair 111 interrupts rotation to temporarily halt the sheet P that comes into contact with the registration roller pair 111. The registration roller pair 111 is timed to resume rotation while sandwiching the sheet P to convey the sheet P to the secondary transfer nip. For example, the registration roller pair 111 resumes rotation in synchronization with a composite color toner image, constituted of the toner images of yellow, cyan, magenta, and black superimposed one atop another on the transfer belt 107*a*, reaching the secondary transfer nip as the transfer belt 107*a* rotates in the rotation direction A.

A toner mark sensor 112 is disposed at a position opposing the transfer belt 107*a* stretched over a circumferential surface of the tension roller 107*c*. The toner mark sensor 112 measures the densities of toner images and the positions of colors on the transfer belt 107*a* with a specular reflection sensor or a diffuse sensor, and adjusts the image densities and color registration.

Below, a description is given of an operation of the image forming apparatus 100 with reference to FIG. 1. As an image forming operation starts in the image forming apparatus 100, a drying device drives and rotates the photoconductive drums 103Y, 103C, 103M, and 103Bk of the process cartridges 101Y, 101C, 101M, and 101Bk, respectively, in a clockwise direction in FIG. 1. The charging rollers 104Y, 104C, 104M, and 104Bk uniformly charge the outer circumferential surfaces of the photoconductive drums 103Y, 103C, 103M, and 103Bk at a predetermined polarity.

The optical writing device 102 emits laser beams Lb onto the charged outer circumferential surfaces of the photoconductive drums 103Y, 103C, 103M, and 103Bk according to yellow, cyan, magenta, and black image data, respectively, to form electrostatic latent images on the surfaces of the photoconductive drums 103Y, 103C, 103M, and 103Bk. Image data optically written on the photoconductive drums 103Y, 103C, 103M, and 103Bk are single-color image data of yellow, cyan, magenta, and black into which a desired full-color image is separated. The developing devices 105Y, 105C, 105M, and 105Bk supply toner of yellow, cyan, magenta, and black to the electrostatic latent images formed on the photoconductive drums 103Y, 103C, 103M, and 103Bk, respectively, thereby developing the electrostatic latent images into visible toner images of yellow, cyan, magenta, and black, respectively.

As a driving device drives and rotates the driving roller 107*b* in a counterclockwise direction in FIG. 1, the driving roller 107*b* rotates the transfer belt 107*a* in the rotational direction A in FIG. 1. A power supply applies a voltage controlled at a constant voltage or current and having a polarity opposite a polarity of the charged toner to each of the primary transfer rollers 107*d*Y, 107*d*C, 107*d*M, and 107*d*Bk. Thus, transfer electric fields are formed at the primary transfer nips formed between the primary transfer rollers 107*d*Y, 107*d*C, 107*d*M, and 107*d*Bk and the photoconductive drums 103Y, 103C, 103M, and 103Bk, respectively. The transfer electric fields generated at the primary transfer nips transfer the yellow, magenta, cyan, and black toner images from the photoconductive drums 103Y, 103C, 103M, and 103Bk onto the transfer belt 107*a* so that the yellow, magenta, cyan, and black toner images are superimposed one on another on the transfer belt 107*a*. Thus, a composite color toner image is formed on the outer circumferential surface of the transfer belt 107*a*.

After the primary transfer of the toner images of yellow, cyan, magenta, and black from the photoconductive drums 103Y, 103C, 103M, and 103Bk onto the transfer belt 107*a*, the cleaning blades 106Y, 106C, 106M, and 106Bk remove residual toner, which remain on the photoconductive drums 103Y, 103C, 103M, and 103Bk, from the photoconductive drums 103Y, 103C, 103M, and 103Bk. Thereafter, dischargers discharge the outer circumferential surfaces of the photoconductive drums 103Y, 103C, 103M, and 103Bk, initializing the surface potential of the photoconductive drums 103Y, 103C, 103M, and 103Bk, and rendering the photoconductive drums 103Y, 103C, 103M, and 103Bk to be ready for the next image formation.

As an image forming operation starts for forming a toner image with the developing devices 105Y, 105C, 105M, and 105Bk supplying toner to the electrostatic latent images on the photoconductive drums 103Y, 103C, 103M, and 103Bk, the sheet feeding roller 109*b* disposed at the lower part of the apparatus body 100A starts rotation. The sheet feeding roller 109*b* picks up and feeds an uppermost sheet P of a plurality of sheets P on the sheet tray 109*a* of the sheet feeding device 109 to the conveyance passage. The registration roller pair 111 is timed to convey the sheet P, thus sent to the conveyance passage by the sheet feeding roller 109*b*, to the secondary transfer nip formed between the secondary transfer roller 107*e* and the transfer belt 107*a*. The secondary transfer roller 107*e* is applied with a transfer voltage having a polarity opposite a polarity of the charged yellow, cyan, magenta, and black toners formed on the transfer belt 107*a*, thus forming a transfer electric field at the secondary transfer nip.

The transfer electric field secondarily transfers the toner images of yellow, cyan, magenta, and black constructing the composite color toner image from the transfer belt 107*a* onto the sheet P collectively. The sheet P bearing the composite color toner image is conveyed to a fixing device 120 where a fixing belt 121 and a pressure roller 126 form a fixing nip N. Thus, the composite color toner image is fixed on the sheet P. As the sheet P is conveyed through the fixing nip N, the fixing belt 121 applies heat to the sheet P. At the same time, the pressure roller 126 exerts pressure on the sheet P, together with the fixing belt 121.

The sheet P bearing the fixed color toner image is ejected by the sheet ejection roller pair 110*b* onto the outside of the apparatus body 100A and stacked on the sheet ejection tray 110*a*. Accordingly, a series of image forming processes performed in the image forming apparatus 100 is completed.

After the secondary transfer of the full color toner image from the transfer belt 107*a* onto the sheet P, the belt cleaning device 108 removes residual toner, which is failed to be transferred onto the sheet P and remains on the transfer belt 107*a*, from the transfer belt 107*a*. The removed toner is conveyed and collected into the waste toner container.

Figure 2:
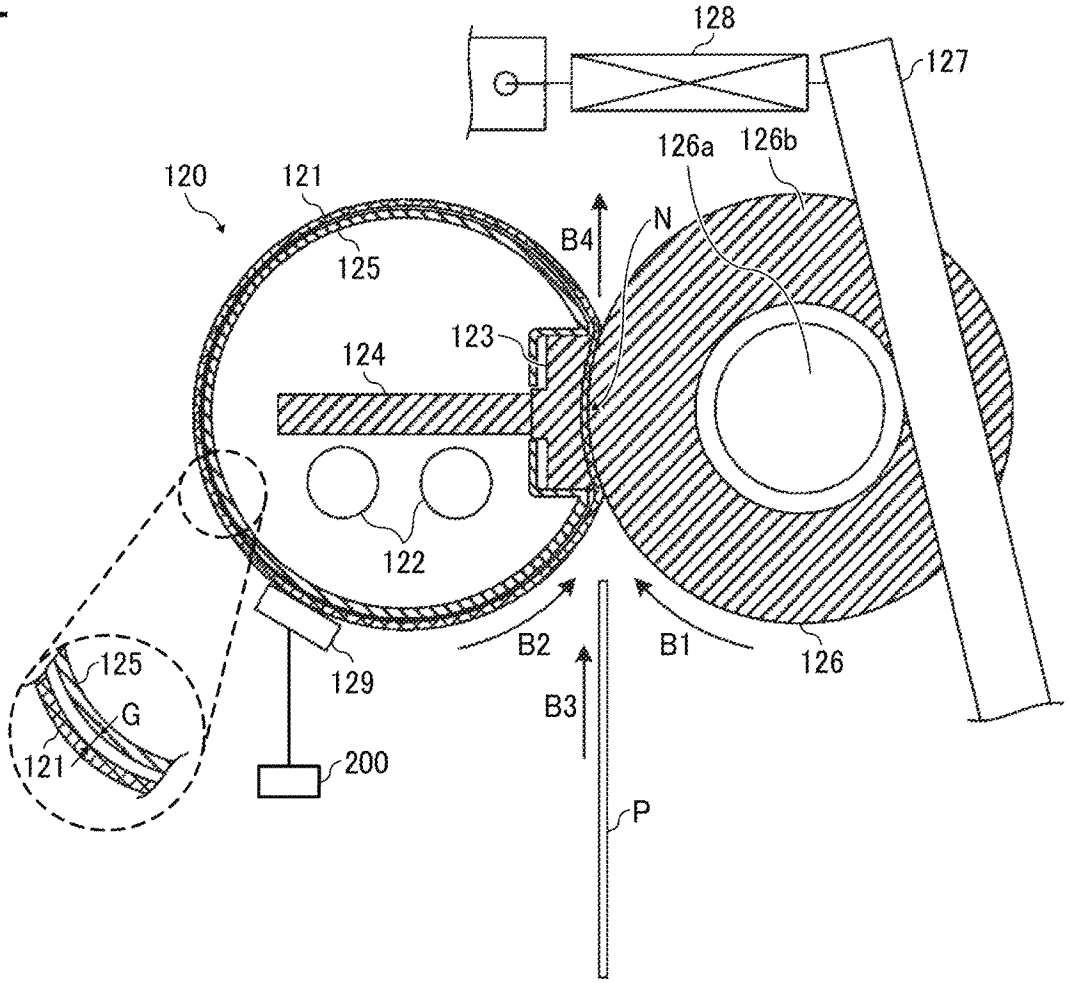
FIG. 2 is a schematic view of a fixing device according to an embodiment of the present disclosure.

Next, a description is provided of the fixing device according to an embodiment of the present disclosure. FIG. 2 is a schematic view of the fixing device 120 according to an embodiment of the present disclosure. As illustrated in FIG. 2, the fixing device 120 includes, e.g., the fixing belt 121 as a fixing rotator, a heater 122 as a heat source, a nip formation pad 123, a reinforcement 124, a thermal conductor 125, the pressure roller 126 as a pressure rotator, a holder 127, and an elastic member 128. The fixing device 120 includes a controller 200 to conduct temperature control of, e.g., fixing temperature according to a temperature detected with a temperature sensor 129 that measures the temperature of fixing belt 121.

After the composite color toner image is transferred from the transfer belt 107*a* to the sheet P at the secondary transfer nip, the sheet P is conveyed to the fixing device 120. When the sheet P passes the fixing nip N between the fixing belt 121 and the pressure roller 126, the fixing device 120 applies heat and pressure to the sheet P to fix the composite color toner image on the sheet P. As the sheet P bearing the fixed toner image is discharged from the fixing nip N, the sheet P separates from the fixing belt 121 and is conveyed to the sheet ejection roller pair 110*b* along the conveyance passage.

The fixing belt 121 rotates in a rotational direction indicated by arrow B2 in FIG. 2 in accordance with rotation of the pressure roller 126 in a rotational direction indicated by arrow B1 in FIG. 2. The fixing belt 121 is driven by the pressure roller 126 as a driving source. The fixing belt 121 and the pressure roller 126 rotate, thereby conveying the sheet P entering the fixing nip N in a sheet conveyance direction B3, and discharging the sheet P from the fixing nip N. The sheet conveyance direction B3 serves as a recording medium conveyance direction.

A description is given of a construction of the pressure roller 126. The pressure roller 126, having a diameter in a range of from about 20 mm to about 40 mm, is constructed of a hollow cored bar 126*a* and an elastic layer 126*b* around the cored bar 126*a*. A rotation shaft of the pressure roller 126 is pressed toward the nip formation pad 123 via the holder 127 by the elastic member 128. The elastic layer 126*b* is made of silicone rubber foam, silicone rubber, fluoro rubber, or the like. Optionally, the pressure roller 126 may further include a thin release layer coating the elastic layer 126*b* and being made of tetrafluoroethylene-perfluoroalkylvinylether copolymer (PFA), polytetrafluoroethylene (PTFE), or the like. The pressure roller 126 is pressed against the fixing belt 121 to form the desired fixing nip N between the pressure roller 126 and the fixing belt 121. A driving gear is mounted on an axial end of the pressure roller 126, and the pressure roller 126 is rotated and driven in the rotational direction B1 in FIG. 2. Optionally, a heater, such as a halogen heater, may be disposed inside the pressure roller 126.

The fixing belt 121 is a free belt not stretched and an endless, thin flexible belt. The fixing belt 121 receives a driving force from the pressure roller 126 to rotate (travel) in the rotational direction B2 in FIG. 2. The fixing belt 121 is constructed of a base layer constituting the inner circumferential surface, an elastic layer coating the base layer, and a release layer coating the elastic layer, which produce a total thickness of the fixing belt 121 not greater than 500 μm. The base layer, the elastic layer, and the release layer are stacked in this order from the side of an inner circumferential surface being a slide surface of the fixing belt 121 that slides the nip formation pad 123. The base layer, having a thickness in a range of from 30 μm to 100 μm, is made of a resin material, such as polyimide. Use of the resin material provides the base layer with low stiffness. Such a configuration allows the fixing belt 121 to more easily wind in an area downstream from an exit of the fixing nip N in the rotational direction B2 of the fixing belt 121. The resin material can reduce the production cost as compared to a metal material. However, the base layer may be made of metal, such as nickel or stainless steel. The elastic layer, having a thickness in a range of from 100 μm to 300 μm, is made of rubber such as silicone rubber, silicone rubber foam, and fluoro rubber. The elastic layer can prevent formation of slight surface asperities of the fixing belt 121 at the fixing nip. Accordingly, heat can be uniformly transmitted to a toner image on the sheet P, thereby preventing formation of a rough image, such as an orange peel image.

The release layer, having a thickness of from 5 μm to 50 μm, may be made of perfluoroalkoxy polytetrafluoroethylene (PFAPTFE), polyimide (PI), polyamide imide (PAI), polyether imide (PEI), polyether sulfide (PES), polyether ether ketone (PEEK), or the like. A loop diameter of the fixing belt 121 is in a range of from 15 mm to 120 mm. According to this exemplary embodiment, the fixing belt 121 has a loop diameter of about 30 mm.

The heater 122, the nip formation pad 123, the reinforcement 124, and the thermal conductor 125, together with, e.g., a first stay, a second stay, and a sheet member, are disposed and fixed inside a loop formed by the fixing belt 121. As the heater 122, a halogen heater or a carbon heater may be used, for example. The nip formation pad 123 is secured (fixed) so as to slide over the inner circumferential surface of the fixing belt 121. The nip formation pad 123 presses against the pressure roller 126 via the fixing belt 121 to form the fixing nip N, through which the sheet P is conveyed. Optionally, a lubricant, such as fluorine grease and silicone oil, may be applied between the thermal conductor 125 and the fixing belt 121 to reduce abrasion of the fixing belt 121 as the fixing belt 121 slides over the thermal conductor 125. In the present embodiment, the thermal conductor 125 is substantially circular in cross-section. However, in some embodiments, the thermal conductor 125 may have any suitable shape in cross section, considering the close contactness of the fixing belt 121 and the thermal conductor 125 from viewpoints of heat transfer efficiency and sliding resistance.

The thermal conductor 125 is heated by radiation heat of the heater 122. The output of the heater 122 is controlled by a power supply unit of the apparatus body 100A. The thermal conductor 125 is a metal thermal conductor made of conductive metal, such as aluminum, iron, and stainless steel. The thermal conductor 125 has a thickness not greater than 0.2 mm, thus allowing effective heating of the fixing belt 121. The thermal conductor 125 is disposed in proximity to or in contact with the inner circumferential surface of the fixing belt 121 at a circumferential span on the fixing belt 121 other than a nip formed between the fixing belt 121 and the nip formation pad 123. At the nip, the thermal conductor 125 includes a recess having an inwardly recessed shape with an opening.

As illustrated in FIG. 2, at an ambient temperature, a gap G (a gap at a position other than the nip) between the fixing belt 121 and the thermal conductor 125 produced at the circumferential span on the fixing belt 121 other than the nip is greater than 0 mm and not greater than 2 mm. Hence, the fixing belt 121 slides over the thermal conductor 125 in a decreased area, suppressing abrasion of the fixing belt 121 that may accelerate as the fixing belt 121 slides over the thermal conductor 125 in an increased area. Simultaneously, the fixing belt 121 is not isolated from the thermal conductor 125 with an excessively increased gap therebetween, suppressing degradation in heating efficiency in heating the fixing belt 121.

Additionally, the thermal conductor 125 disposed in proximity to the fixing belt 121 retains a circular shape of the flexible fixing belt 121, reducing deformation and resultant degradation and breakage of the fixing belt 121. In order to decrease resistance between the thermal conductor 125 and the fixing belt 121 sliding thereover, a slide face, that is, an outer circumferential surface, of the thermal conductor 125 may be made of a material having a decreased friction coefficient or the inner circumferential surface of the fixing belt 121 may be coated with a surface layer made of a material containing fluorine. If the fixing device 120 includes a separate component that conducts heat from the heater 122 to the fixing belt 121 evenly and stabilizes motion of the fixing belt 121 as the fixing belt 121 is driven, the fixing device 120 may employ a direct heating method in which the heater 122 heats the fixing belt 121 directly without the thermal conductor 125. In this case, the fixing device 120 reduces its total thermal capacity by a thermal capacity of the thermal conductor 125, heating the fixing belt 121 quickly and saving energy.

The output of the heater 122 is controlled based on the temperature of the outer circumferential surface of the fixing belt 121 detected by the temperature sensor 129. The temperature sensor 129 includes, e.g., a thermistor disposed opposite the outer circumferential surface of the fixing belt 121. Thus, the fixing belt 121 is heated to a desired fixing temperature by the heater 122 controlled as described above.

A description is provided of a fixing operation performed by the fixing device 120 having the construction described above. As the image forming apparatus 100 is powered on, the heater 122 is supplied with power and the driving device starts driving and rotating the pressure roller 126 in the rotational direction B1 in FIG. 2. The fixing belt 121 is driven and rotated the rotational direction B2 in FIG. 2 by friction between the fixing belt 121 and the pressure roller 126. Then, the sheet feeding roller 109*b* picks up and feeds a sheet P from the sheet tray 109*a* to the registration roller pair 111 that conveys the sheet P to the secondary transfer nip where an unfixed color toner image is secondarily transferred from the transfer belt 107*a* onto the sheet P at the position of the secondary transfer roller 107*e*. The sheet P bearing the unfixed toner image is conveyed in a direction indicated by arrow B3 in FIG. 2 while guided by a guide plate, and enters the fixing nip N formed between the fixing belt 121 and the pressure roller 126 pressed against the fixing belt 121. The heat of the heater 122 is conducted to the thermal conductor 125. The toner image is fixed on the surface of the sheet P under the heat of the fixing belt 121 heated by the thermal conductor 125 and the pressure of the nip formation pad 123 and the pressure roller 126 reinforced by the reinforcement 124. Then, the sheet P sent from the fixing nip N is conveyed in a direction indicated by arrow B4 in FIG. 2. Thus, the fixing device 120 completes a series of fixing processes.

Figure 3:
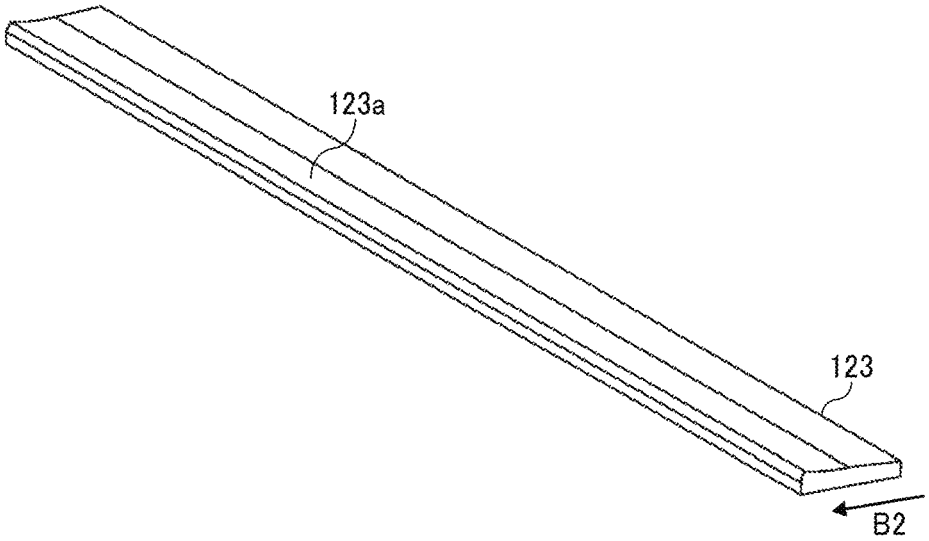
FIG. 3 is a perspective view of a portion of a nip formation pad according to an embodiment of the present disclosure.
Figure 4:
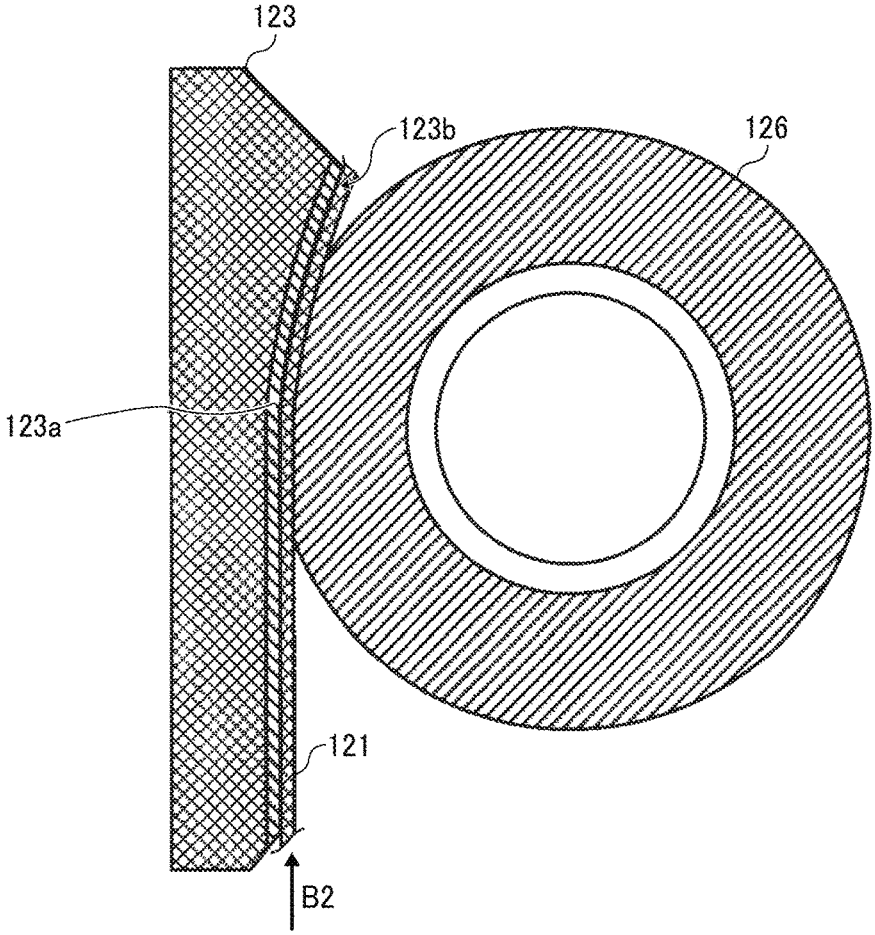
FIG. 4 is a schematic view of the nip formation pad and the pressure roller seen from a direction of the rotation shaft of the pressure roller.
Figure 5:
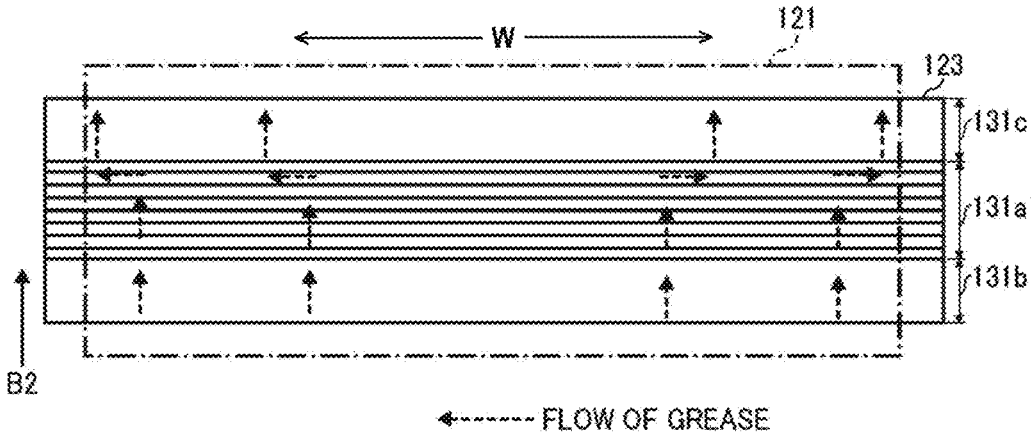
FIG. 5 is a plan view of a comparative example of the nip formation pad.
Figure 6:
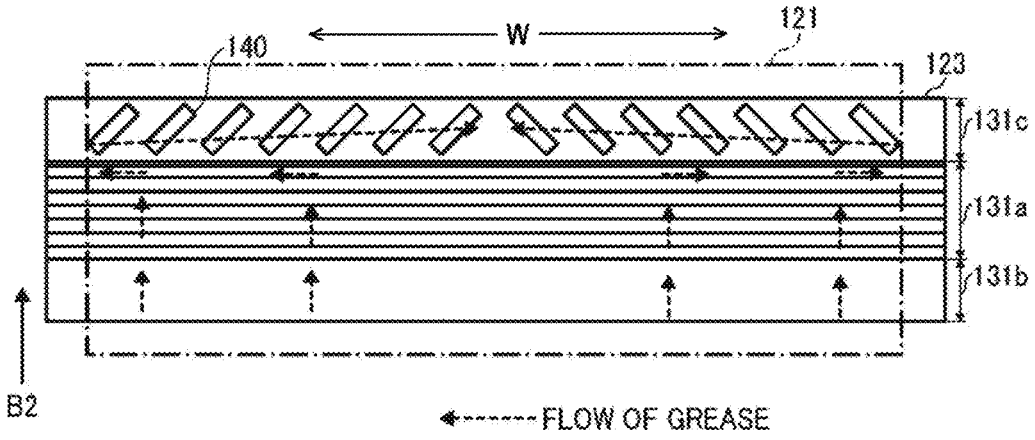
FIG. 6 is a plan view of the nip formation pad with inclined grooves according to an embodiment of the present disclosure.

FIG. 3 is a perspective view of a portion of the nip formation pad in the present embodiment. FIG. 4 is a schematic view of the nip formation pad and the pressure roller seen from a direction of the rotation shaft of the pressure roller. FIG. 5 is a plan view of a comparative example of the nip formation pad. FIG. 6 is a plan view of the nip formation pad in the present embodiment.

As illustrated in FIGS. 3 and 4, the slide face of the nip formation pad 123 is coated with ceramic coating 123*a* to reduce the sliding resistance against the fixing belt 121. Fluorine grease 123*b* as a lubricant is also adhered to the slide face of the nip formation pad 123. Such a configuration can reduce the sliding resistance of the nip formation pad 123 against the fixing belt 121 and the abrasion of the inner circumferential surface of the fixing belt 121 made of a resin material. The ceramic coating 123*a* is coated at a thickness of from 10 μm to 30 μm.

Seen from a width direction, indicated by arrow W in FIGS. 5 and 6, perpendicular to the rotational direction B2 of the fixing belt 121, the pressure roller 126 is pressed against an upstream end of the nip formation pad 123, which has the slide face against the fixing belt 121, in the rotational direction B2 of the fixing belt 121 and deforms to be compressed in a thickness direction of the pressure roller 126. Thus, the pressure roller 126 is temporarily separated from the slide face of the nip formation pad 123. As the pressure roller 126 further rotates toward a downstream side in the rotational direction B2 of the fixing belt 121, the pressure roller 126 gradually restores and slides over the slide face of the nip formation pad 123 to be compressed. The load of the pressure roller 126 on the nip formation pad 123 is largest in an area near the exit of the fixing nip N at the downstream side of the nip formation pad 123 in the rotational direction B2 of the fixing belt 121.

Accordingly, as illustrated in FIG. 5, the fluorine grease 123*b* adhering to the inner circumferential surface of the fixing belt 121 is less likely to flow toward the downstream side in the rotational direction B2 of the fixing belt 121 in an area near an exit of a nip area 131*a* corresponding to the nip formed by the fixing belt 121 and the nip formation pad 123. Accordingly, as a subsequent portion of the fluorine grease 123*b* flows into the area near the exit of the nip area 131*a*, the amount of the fluorine grease 123*b* remaining on the area gradually increases. An excessive portion of fluorine grease 123*b* moves to the width direction perpendicular to the rotational direction B2 of the fixing belt 121. Such excessive fluorine grease may leak from ends of the nip formation pad 123 in the width direction over time. Consequently, the total amount of the fluorine grease 123*b* adhering to the fixing belt 121 may decrease, thus increasing the sliding resistance of the nip formation pad 123 against the fixing belt 121. As a result, it may be difficult to obtain high durability.

For example, as illustrated in FIG. 2, the area of the nip formation pad 123 near the exit of the fixing nip N has a circular shape along the outer circumferential surface of the pressure roller 126 to facilitate the separation of the sheet P. Accordingly, in the area near the exit of the nip area 131*a*, the load of the pressure roller 126 against the nip formation pad 123 more increases. Consequently, the amount of fluorine grease 123*b* leaking from an end of the nip formation pad 123 in the width direction increases over time, thus increasing the speed of decreasing the total amount of fluorine grease 123*b* adhering to the inner circumferential surface of the fixing belt 121. As a result, the sliding resistance of the nip formation pad 123 against the fixing belt 121 would rapidly increase.

To prevent such an increase in sliding resistance, as illustrated in FIG. 6, a plurality of inclined grooves 140 inclined from each end to a center in the width direction is formed on a face of the nip formation pad 123 corresponding to an area (an exit area 131*c*) near the exit of the nip area 131*a* at the downstream side in the rotational direction B2 of the fixing belt 121. On the other hand, such inclined grooves are not formed on a face of the nip formation pad 123 corresponding to an area (an entry area 131*b*) near the entry of the nip area 131*a* at the upstream side in the rotational direction B2 of the fixing belt 121. With such a configuration, the fluorine grease 123*b* between the inner circumferential surface of the fixing belt 121 and the nip formation pad 123 is temporarily reserved in groove portions of the inclined grooves 140. The reserved fluorine grease 123*b* flows along the groove portions of the inclined grooves 140 toward the center in the width direction, thus suppressing leakage of the fluorine grease 123*b* from ends of the nip formation pad 123 in the width direction. Accordingly, the total amount of fluorine grease 123*b* adhering to the inner circumferential surface of the fixing belt 121 can be maintained. Note that a slide-face edge portion of the inclined groove 140 formed on the nip formation pad 123, in particular, a boundary portion between an inner wall of the groove facing the upstream side in the rotational direction B2 of the fixing belt 121 and the slide face of the nip formation pad 123 may have a curved surface (see FIG. 8B), thus suppressing the abrasion of the inner circumferential surface of the fixing belt 121 and the increase in sliding resistance.

As illustrated in FIG. 6, each of the plurality of inclined grooves 140 is longer in the rotational direction B2 of the fixing belt 121 than in the width direction perpendicular the rotational direction B2 of the fixing belt 121. Such a configuration can reserve the fluorine grease 123*b* moved to ends in the width direction in the plurality of inclined grooves 140, thus allowing the fluorine grease 123*b* to be more effectively returned to the center in the width direction.

Figure 7:
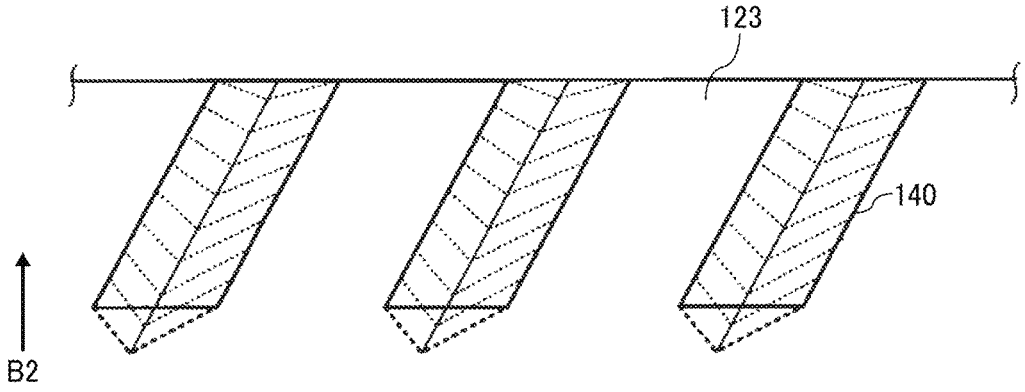
FIG. 7 is a schematic view of another example of the inclined grooves.
Figure 8A:
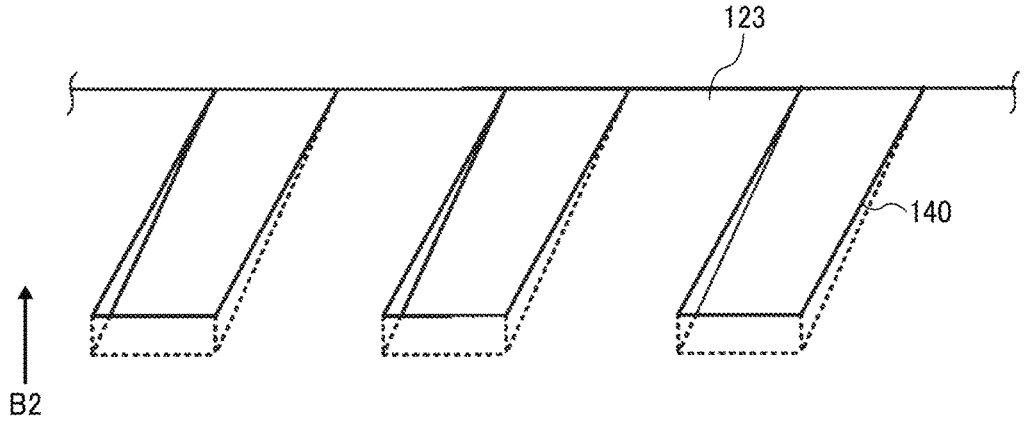
FIG. 8A is a schematic view of still another example of the inclined grooves.
Figure 8B:
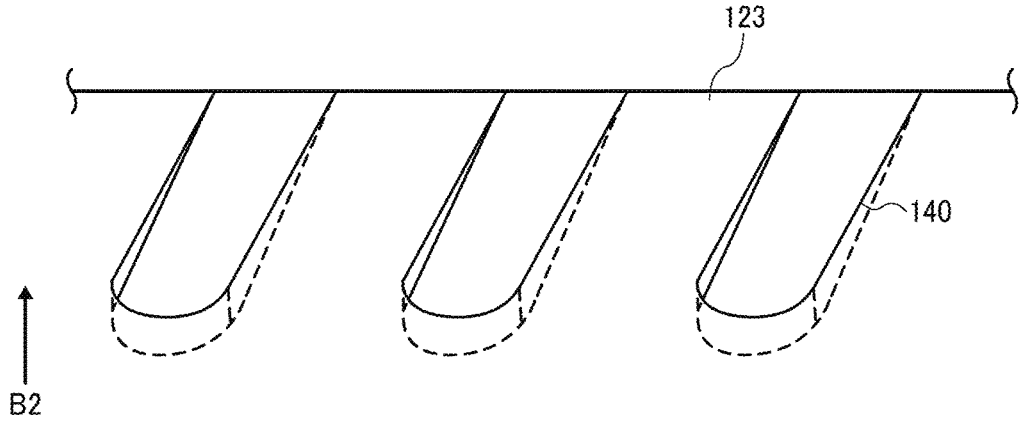
FIG. 8B is a schematic view of still yet another example of the inclined grooves.
Figure 9:
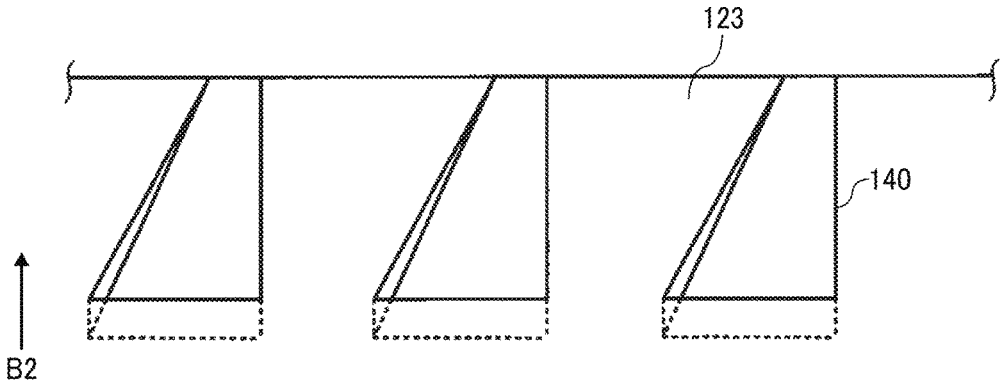
FIG. 9 is a schematic view of still further, yet another example of the inclined grooves.

Note than, as illustrated in FIGS. 7, 8, and 9, the depth of the groove portion of the inclined groove 140 gradually decreases from the upstream side toward the downstream side in the rotational direction B2 of the fixing belt 121. Such a configuration allows the fluorine grease to smoothly flow out the groove portion of the inclined groove 140, thus allowing the fluorine grease to more effective adhere to the inner circumferential surface of the fixing belt 121. The ends of the inclined groove 140 in the rotational direction B2 of the fixing belt 121 are continuous with the slide face of the nip formation pad 123 against the fixing belt 121. Thus, the inclined grooves 140 serve as lubricant transfer portions. Such a configuration allows all the fluorine grease temporarily remaining in the inclined grooves 140 to smoothly flow out the inclined grooves 140, thus allowing the fluorine grease to more effectively adhere to the inner circumferential surface of the fixing belt 121. The bottom shape of the inclined groove 140 in cross section in the thickness direction of the inclined groove 140 is, for example, a triangular shape illustrated in FIG. 7 or a flat shape illustrated in FIG. 8A. As illustrated in FIG. 9, an inner wall of the inclined groove 140 may be inclined in the rotational direction B2 of the fixing belt 121 only at one side in the width direction perpendicular the rotational direction B2 of the fixing belt 121. The mechanism of moving the fluorine grease toward the center of the nip formation pad 123 in the width direction is not limited to the above-described inclined groove but, for example, may be a guide formed of guide walls or projections inclined from the ends to the center of the nip formation pad in the width direction.

The exemplary embodiments described above are one example and attain advantages below in a plurality of aspects A to J.

Aspect A

A fixing device, such as the fixing device 120, includes an endless fixing rotator, such as the fixing belt 121, having an inner circumferential surface adhered with a lubricant; a nip formation pad, such as the nip formation pad 123; a pressure rotator, such as the pressure roller 126, pressed against the nip formation pad via the fixing rotator to form a nip through which an image is fixed on a recording medium; and a lubricant transfer portion, such as the inclined grooves 140, to transfer the lubricant toward a center side in a width direction perpendicular to a rotational direction of the fixing rotator. Generally, according to the fixing device, since the nip is favorably formed, at least one of the pressure rotator and the fixing rotator includes an elastic layer. For example, when the pressure rotator having the elastic layer is seen from the width direction perpendicular to the rotational direction of the fixing rotator, the pressure rotator is pressed against an upstream end of the nip formation pad, which has a slide face against the fixing rotator, in the rotational direction of the fixing rotator in fixing and deforms to be compressed in a thickness direction of the pressure rotator. As the pressure rotator moves to the downstream side from the end in the rotational direction of the fixing rotator, the pressure rotator gradually restores. The load of the pressure rotator against the nip formation pad in the nip increases as the pressure rotator approached an area near the exit of the nip formation pad at the downstream side in the rotational direction of the fixing rotator. Accordingly, the lubricant adhering to the inner circumferential surface of the fixing rotator less easily flows downstream in the rotational direction of the fixing rotator near the exit of the nip. Since subsequent lubricant flows to the area near the nip, the amount of the lubricant remaining on the area gradually increases. An excessive lubricant moves in the width direction perpendicular to the rotational direction of the fixing rotator. Such excessive lubricant may leak from an end of the nip formation pad in the width direction over time. Consequently, the total amount of the lubricant adhering to fixing rotator may decrease, thus increasing the sliding resistance of the nip formation pad against the fixing rotator. In the present aspect, the lubricant transfer portion transfers the lubricant to the center side in the width direction perpendicular to the rotational direction of the fixing rotator. Such a configuration can return the lubricant, which has moved to ends in the width direction, to the center side, thus reducing leakage of the lubricant from ends of the nip formation pad in the width direction. Accordingly, the decrease in the total amount of the lubricant adhering to the inner circumferential surface of the fixing rotator is suppressed, thus suppressing the increase in the sliding resistance of the nip formation pad against the fixing rotator. Thus, a reduction in slide performance of the fixing rotator and the nip formation pad can be suppressed.

Aspect B

In aspect A, the lubricant transfer portion includes a groove, such as the inclined groove 140, on a face of the nip formation pad opposing the fixing rotator at a downstream side from the nip in the rotational direction of the fixing rotator. In a direction from an upstream side to a downstream side of the groove in the rotational direction of the fixing rotator, the groove is inclined from an end side to the center side of the nip formation pad in the width direction. With such a configuration, the lubricant having moved toward axial ends of the nip formation pad is reserved by the groove. The lubricant flows along the groove and is transferred from an end side to the center side. Thus, leakage of the lubricant from ends in the width direction can be suppressed, thus reducing the decrease in the total amount of the lubricant.

Aspect C

In aspect B, as the groove, a plurality of grooves is arranged in the width direction perpendicular to the rotational direction of the fixing rotator. With such a configuration, the lubricant adhering to the inner circumferential surface of the fixing rotator is segmented and retained by a plurality of grooves, thus allowing the lubricant to be evenly spread in the width direction of the nip. Accordingly, a reduction in slide performance of the fixing rotator and the nip formation pad can be further suppressed.

Aspect D

In any of aspects A to C, a downstream end of the nip formation pad in the nip in the rotational direction of the fixing rotator has a circular shape along an outer circumferential surface of the pressure rotator. Such a configuration facilitates winding of a recording sheet after fixing and enhances the separation performance of the recording medium.

Aspect E

In any of aspects B to D, the groove is longer in the rotational direction of the fixing rotator than in the width direction. Such a configuration allows the lubricant having moved to ends in the width direction to be reserved in a larger number of grooves, thus effectively returning the lubricant to the center in the width direction.

Aspect F

In any of aspects B to E, a downstream end of the groove in the rotational direction of the fixing rotator is continuous with a slide face of the nip formation pad that slides over the fixing rotator. Such a configuration allows all the grease reserved in the groove to smoothly flow out the groove, thus allowing the grease to more effectively adhere to the inner circumferential surface of the fixing rotator.

Aspect G

In any of aspects B to F, a boundary portion between an inner wall of the groove facing an upstream side in the rotational direction of the fixing rotator and a slide face of the nip formation pad has a curved surface. Such a configuration can suppress the abrasion of the inner circumferential surface of the fixing rotator and an increase in sliding resistance.

Aspect H

In any of aspects B to G, the depth of the groove gradually decreases from an upstream side to a downstream side in the rotational direction of the fixing rotator. Such a configuration allows the lubricant reserved in the groove to favorably flow out the groove, thus allowing the lubricant to more effectively adhere to the inner circumferential surface of the fixing rotator.

Aspect I

In any of aspects A to H, the lubricant is fluorine grease.

Aspect J

An image forming apparatus, such as the image forming apparatus 100, includes an image bearer, such as the transfer belt 107*a*; an image forming device, such as the process cartridges 101Y, 101C, 101M, and 101Bk, to form a toner image on the image bearer; a transfer device, such as the transfer device 107, to transfer the toner image from the image bearer onto a recording medium; and a fixing device, such as the fixing device 120, to fix the toner image on the recording medium. The fixing device is the fixing device according to any of aspects A to I. According to the present aspect, leakage of the lubricant can be suppressed, thus suppressing a reduction in lubricating performance of the lubricant. Accordingly, a reduction in slide performance of the fixing rotator and the nip formation pad can be suppressed, thus reducing defective rotation of the fixing rotator and allowing excellent image formation.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device comprising:

an endless fixing rotator having an inner circumferential surface adhered with a lubricant;

a nip formation pad disposed inside a loop of the fixing rotator;

a pressure rotator pressed against the nip formation pad via the fixing rotator to form a nip through which an image is fixed on a recording medium; and a lubricant transfer structure that includes at least one groove to transfer the lubricant toward a center area in a width direction perpendicular to a rotational direction of the fixing rotator, the at least one groove being disposed to extend outward from the center area at least to one or more outer edge of the fixing rotator in the width direction, and an outermost end of the at least one groove in the width direction is covered by the fixing rotator.

2. The fixing device according to claim 1, wherein the at least one groove of the lubricant transfer structure includes a first groove on a face of the nip formation pad opposing the fixing rotator at a downstream side from the nip in the rotational direction of the fixing rotator, and wherein, in a direction from an upstream side to a downstream side of the first groove in the rotational direction of the fixing rotator, the first groove is inclined from an end side to the center area in the width direction.

3. The fixing device according to claim 2, wherein the at least one groove of the lubricant transfer structure includes multiple grooves arranged in the width direction.

4. The fixing device according to claim 2, wherein the first groove is longer in the rotational direction of the fixing rotator than in the width direction.

5. The fixing device according to claim 2, wherein a downstream end of the first groove in the rotational direction of the fixing rotator is continuous with a slide face of the nip formation pad that slides over the fixing rotator.

6. The fixing device according to claim 2, wherein a boundary between an inner wall of the first groove opposing an upstream side in the rotational direction of the fixing rotator and a slide face of the nip formation pad has a curved surface.

7. The fixing device according to claim 2, wherein a depth of the first groove gradually decreases from an upstream side to a downstream side in the rotational direction of the fixing rotator.

8. The fixing device according to claim 1, wherein a downstream end of the nip formation pad in the nip in the rotational direction of the fixing rotator has a circular shape along an outer circumferential surface of the pressure rotator.

9. The fixing device according to claim 1, wherein the lubricant is fluorine grease.

10. The fixing device according to claim 1, wherein the lubricant transfer structure includes the at least one groove being disposed to extend outward from the center area at least to two outer edges of the fixing rotator in the width direction.

11. The fixing device according to claim 1, further comprising a thermal conductor disposed and fixed inside the loop formed by the endless fixing rotator.

12. The fixing device according to claim 11, wherein the thermal conductor is a metal thermal conductor.

13. The fixing device according to claim 11, further comprising a heater inside the loop formed by the endless fixing rotator, to directly heat the endless fixing rotator with no thermal conductor interposed between the heater and the endless fixing rotator.

14. An image forming apparatus comprising:

an image bearer;

an image forming device to form a toiler image on the image bearer;

a transfer device to transfer the toner image from the image bearer onto a recording medium; and a fixing device to fix the toner image on the recording medium, the fixing device including:

a nip formation pad;

an endless fixing rotator having an inner circumferential surface adhered with a lubricant;

a pressure rotator pressed against the nip formation pad via the fixing rotator to form a nip through which the image is fixed on the recording medium; and a lubricant transfer structure that includes at least one groove to transfer the lubricant toward a center area in a width direction perpendicular to a rotational direction of the fixing rotator, the at least one groove being disposed to extend outward from the center area at least to an outer edge of the fixing rotator in the width direction, and an outermost end of the at least one groove in the width direction is covered by the fixing rotator.

* * * * *